US008362717B2

(12) United States Patent
Chen

(10) Patent No.: US 8,362,717 B2
(45) Date of Patent: Jan. 29, 2013

(54) METHOD OF DRIVING AN INJECTOR IN AN INTERNAL INJECTION BETATRON

(75) Inventor: Felix K. Chen, Newtown, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 933 days.

(21) Appl. No.: 12/334,502

(22) Filed: Dec. 14, 2008

(65) Prior Publication Data

US 2010/0148705 A1 Jun. 17, 2010

Related U.S. Application Data

(63) Continuation-in-part of application No. 12/334,495, filed on Dec. 14, 2008, now Pat. No. 7,994,739.

(51) Int. Cl.
*H05H 11/00* (2006.01)

(52) U.S. Cl. ..... 315/504; 315/502; 315/507; 378/121

(58) Field of Classification Search ..... 315/501, 315/504, 507

See application file for complete search history.

(56) References Cited

U.S. PATENT DOCUMENTS

| | | | | |
|---|---|---|---|---|
| 2,103,303 | A | 12/1937 | Steenbeck | |
| 2,394,071 | A | 2/1946 | Kerst | |
| 2,447,255 | A | 8/1948 | Kerst et al. | |
| 2,473,123 | A | 6/1949 | Adams | |
| 2,528,525 | A | 11/1950 | Langmuir et al. | |
| 2,528,526 | A | 11/1950 | Westendorp | |
| 2,533,859 | A | 12/1950 | Wideroe | |
| 2,538,718 | A | 1/1951 | Wideroe | |
| 2,540,853 | A | 2/1951 | Wilkinson et al. | |
| 2,558,597 | A | 6/1951 | Westendorp | |
| 2,572,414 | A | 10/1951 | Wideroe | |
| 2,572,551 | A | 10/1951 | Wideroe | |
| 2,586,494 | A | 2/1952 | Wideroe | |
| 2,654,838 | A | 10/1953 | Wideroe | |
| 2,660,673 | A | 11/1953 | Westendorp | |
| 2,675,470 | A | 4/1954 | Wideroe | |
| 2,698,384 | A | 12/1954 | Wideroe | |
| 2,797,322 | A | 6/1957 | Von Arx | |
| 2,825,833 | A | 3/1958 | Yanagisawa et al. | |
| 3,321,625 | A | 5/1967 | Wahl | |
| 3,614,638 | A | 10/1971 | Anaviev et al. | |
| 3,769,599 | A * | 10/1973 | Leboutet et al. | 315/507 |
| 3,805,202 | A | 4/1974 | Chakhlov et al. | |
| 3,975,689 | A | 8/1976 | Geizer et al. | |
| 3,976,879 | A | 8/1976 | Turcotte | |

(Continued)

FOREIGN PATENT DOCUMENTS

| | | | |
|---|---|---|---|
| EP | 481865 | B1 | 3/1996 |
| RU | 1584731 | A1 * | 5/1993 |

OTHER PUBLICATIONS

M. Baxendale, The physics and applications of carbon nanotubes, Journal of Material Science, Materials in Electronics 14(2003), 657-659.*

(Continued)

*Primary Examiner* — Douglas W Owens
*Assistant Examiner* — Jonathan Cooper
(74) *Attorney, Agent, or Firm* — Jakub Michna; Rachel E. Greene; Bridget Laffey

(57) ABSTRACT

A betatron magnet, the betatron magnet comprising at least one electron injector positioned approximate an inside of a radius of an betatron orbit, such that electrons are injected into the betatron orbit with the at least one electron injector positioned within an electron acceleration passageway, whereby the electron acceleration passageway is located within a vacuum chamber; and wherein the at least one electron injector is driven with an inductive means.

21 Claims, 6 Drawing Sheets

U.S. PATENT DOCUMENTS

| | | | | |
|---|---|---|---|---|
| 3,996,473 | A | 12/1976 | Culver | |
| 4,093,854 | A | 6/1978 | Turcotte et al. | |
| 4,392,111 | A | 7/1983 | Rostoker | |
| 4,577,156 | A | 3/1986 | Kerst | |
| 4,713,581 | A | 12/1987 | Haimson | |
| 4,823,044 | A | 4/1989 | Falce | |
| 5,077,530 | A | 12/1991 | Chen | |
| 5,122,662 | A * | 6/1992 | Chen et al. | 250/269.3 |
| 5,202,604 | A | 4/1993 | Kweon | |
| 5,293,410 | A | 3/1994 | Chen et al. | |
| 5,319,314 | A | 6/1994 | Chen | |
| 5,426,409 | A | 6/1995 | Johnson | |
| 5,525,797 | A | 6/1996 | Moake | |
| 5,600,213 | A | 2/1997 | Hiramoto et al. | |
| 5,680,018 | A | 10/1997 | Yamada | |
| 5,717,204 | A | 2/1998 | Meisburger et al. | |
| 5,745,536 | A | 4/1998 | Brainard et al. | |
| 5,804,820 | A | 9/1998 | Evans et al. | |
| 5,912,460 | A | 6/1999 | Stoller et al. | |
| 6,121,850 | A | 9/2000 | Ghoshal | |
| 6,201,851 | B1 | 3/2001 | Piestrup et al. | |
| 6,441,569 | B1 | 8/2002 | Janzow | |
| 6,583,548 | B2 | 6/2003 | Cho et al. | |
| 6,713,976 | B1 * | 3/2004 | Zumoto et al. | 315/500 |
| 6,925,137 | B1 | 8/2005 | Forman | |
| 7,148,613 | B2 | 12/2006 | Dally et al. | |
| 7,638,957 | B2 | 12/2009 | Chen | |
| 7,675,252 | B2 | 3/2010 | Chen et al. | |
| 7,916,838 | B2 * | 3/2011 | Perkins et al. | 378/113 |
| 7,994,739 | B2 | 8/2011 | Chen | |
| 7,994,740 | B2 | 8/2011 | Bermuth et al. | |
| 8,035,321 | B2 * | 10/2011 | Chen et al. | 315/504 |
| 2009/0153079 | A1 * | 6/2009 | Perkins et al. | 315/504 |

OTHER PUBLICATIONS

Ellis et al., Well Logging for Earth Scientists, Springer, 2nd edition, 2007, pp. 345-379.

* cited by examiner

METHOD OF DRIVING AN INJECTOR IN AN INTERNAL INJECTION BETATRON

CROSS REFERENCE TO RELATED APPLICATION(S)

This application is a continuation-in-part of U.S. patent application Ser. No. 12/334,495 titled "Internal Injection Betatron" by Felix Chen filed Dec. 13, 2008, which is hereby incorporated by reference. U.S. patent application Ser. No. 12/334,495 claims priority from U.S. patent application Ser. No. 11/957,178 titled "Single Drive Betatron" by Felix Chen filed Dec. 14, 2007, which is incorporated by reference herein in its entirety.

BACKGROUND OF THE INVENTION

1. Field of the Invention

This invention generally relates to methods and devices of formation evaluation using a switchable source, in particular, driving an injector through an inductive means in an internal injection scheme.

2. Background of the Invention

Known methods and devices of formation evaluation are typically used in oil well bore hole logging applications, such applications are understood as a process where properties of earth strata as a function of depth in the bore hole are measured. For example, geologists reviewing the logging data can determine the depths at which oil containing formations are most likely located. One important piece of the logging data is the density of the earth formation. Most present day well logging relies on gamma-rays obtained from chemical radiation sources to determine the bulk density of the formation surrounding a borehole. These sources pose a radiation hazard and require strict controls to prevent accidental exposure or intentional misuse. In addition, most sources have a long half life and disposal is a significant issue. For some logging applications, in particular determination of formation density, a $^{137}$Cs source or a $^{60}$Co source is used to irradiate the formation. The intensity and penetrating nature of the radiation allow a rapid, accurate, measurement of the formation density. In view of the problems with chemical radiation sources, it is important that chemical radiation sources be replaced by electronic radiation sources.

One proposed replacement for chemical gamma-ray sources is a betatron accelerator. In this device, electrons are accelerated on a circular path by a varying magnetic field until being directed onto a target. The interaction of the electrons with the target leads to the emission of Bremsstrahlung and characteristic x-rays of the target material. Before electrons can be accelerated, they are injected into a magnetic field between two circular pole faces at the right time, with correct energy and correct angle. Control over timing, energy and injection angle enables maximizing the number of electrons accepted into a main electron orbit and accelerated.

A typical betatron, as disclosed in U.S. Pat. No. 5,122,662 to Chen et al. has a pole face diameter of about 4.5 inches. The magnet consists of two separated, magnetically isolated pieces: a core with a magnetic circuit that is a nearly closed loop and a guide field magnet that includes two opposing pole faces separated by a gap of about 1 centimeter. The pole faces that encompass the core have a toroidal shape. A gap of about 0.5 cm separates the core from the inner rims of the pole faces. The two pieces are driven by two separated sets of coils connected in parallel: a field coil wound around the outer rims of the pole faces and a core coil wound on a center section of the core. The field magnet and the core are magnetically decoupled with a reverse field coil wound on top of the core coil. Both the core coil and the reverse field coil locate in the 0.5 cm gap. U.S. Pat. No. 5,122,662 is incorporated by reference in its entirety herein.

In operation, a typical betatron satisfies the betatron condition and accelerates electrons to relativistic velocity. The betatron condition is satisfied when:

$$\Delta\phi_0 = 2\pi r_0^2 \Delta B_{y,0}$$

where:

$r_0$ is the radius of a betatron orbit located approximately at the center of the pole faces;

$\Delta\phi_0$ is the change of flux enclosed within $r_0$; and $\Delta B_{y,0}$ is the change in guide field at $r_0$.

The betatron condition may be met by adjusting the core coil to guide field coil turn ratio as disclosed in U.S. Pat. No. 5,122,662. Satisfying the betatron condition does not insure the machine will work. Charge trapping, injecting electrons into the betatron orbit at the optimal point of time, is another challenging operation. In the 4.5 inch betatron, this is accomplished by holding the flux in the core constant while increasing the guide field. It can be done because the core and guide field are driven independently.

Large betatrons are suitable for applications where size constraints are not critical, such as to generate x-rays for medical radiation purposes. However, in applications such as oil well bore holes where there are severe size constraints, it is desired to use smaller betatrons, typically with a magnetic field diameter of three inches or less. The conventional design for large betatrons is not readily applied to smaller betatrons for at least three reasons:

(1) If the electron injector is located in the gap between pole faces, the gap height must be larger than the dimension of the injector perpendicular to the pole faces. In order to maintain a reasonable beam aperture, the width of the pole faces cannot be reduced too much either. Thus, the burden of the size reduction falls mostly on the core, resulting in significantly lower beam energy.

(2) If the electron injector is located in the gap between the pole faces, one must, within a time period comparable to the orbit period of electrons, alter the injected electrons trajectories such that they do not hit the injector. Those electrons whose trajectories do not intercept either the injector structure or the vacuum chamber walls are said to be trapped. Only trapped electrons may be accelerated to full energy and caused to impinge on the target and produce radiation. Due to the nature of the charge trapping mechanism, the probability of trapping any charge in a 3 inch machine is almost nil unless the modulation frequency of the main drive is increased to about 24 kHz (triple that of a 4.5 inch machine) and the injection energy is reduced to about 2.5 kV (½ that of the 4.5 inch machine). Even then, the prospect of trapping a charge comparable to that trapped in a 4.5 inch machine is poor.

(3) A higher flux density is required to confine the same energy electrons to a smaller radius. A higher flux density and modulation frequency results in a higher power loss in a three inch betatron, even though it has a smaller volume than a 4.5 inch betatron.

As a result of (1)-(3), it is estimated that the useable radiation output of a three inch betatron with the conventional design would be three orders of magnitude lower than the 4.5 inch betatron. There exists a need for a small diameter betatron having a radiation output comparable to the 4.5 inch betatron.

Further, the source intensity from a betatron can depend on several factors, for example, the number of electrons hitting the target and the energy of those electrons. The energy of the electrons can be limited by material properties and available power whereas the former is mainly an issue of the amount of charge trapped, which is in turn affected by strength of the focusing forces, the space charge forces, and the efficiency of the charge trapping mechanism. The trapped charge is always less than the maximum allowed charge because the mechanism isn't 100% efficient. For example, the conventional approach uses an external injection scheme which provides for inefficient trapping in a small betatron.

In a small circular electron accelerator such as a betatron, injection of elections into the acceleration cavity poses a significant challenge. The betatron is a fix orbit machine. Namely, during acceleration the radius of the accelerating beam remains more or less constant. Injection is often done by installing the injector just outside the radius of the main accelerating beam orbit. To avoid hitting the injector, the orbit radius of the injected beam is contracted rapidly. The process reverses after the electron beam has reached the desired energy. As the electron beam expands, it impinges on the first structure (target) it encounters to produce radiation.

Therefore, there is a need for sourceless formation evaluation devices and methods that overcome the above noted limitations of the prior art.

SUMMARY OF THE INVENTION

According to embodiments of the invention, the invention includes a betatron magnet, the betatron magnet comprising at least one electron injector positioned approximate an inside of a radius of an betatron orbit, such that electrons are injected into the betatron orbit with the at least one electron injector positioned within an electron acceleration passageway, whereby the electron acceleration passageway is located within a vacuum chamber; and wherein the at least one electron injector is driven with an inductive means.

According to aspects of the invention, the invention includes the inductive means having an injection coil wound around an inside portion of a vacuum chamber wall of the vacuum chamber, such that a positive end of the injection coil is connected to an anode, and a negative end of the injection coil is connected to a cathode. Further, the inductive means having one of a diode or an intermediate tap connected to a grid for a triode injector. Further still, the inductive means having a resistive coating is located on at least one portion of an interior surface of the vacuum chamber, and a ground connection is structured and arranged through an outside wall of the vacuum chamber to the resistive coating. The inductive means can drive the at least one electron injector, whereby high voltage pulses for driving the injector are obtained from the injection coil wound around the inside portion of the vacuum chamber wall, such that the positive end of the injection coil is connected to the anode and the resistive coating, and the negative end of the injection coil is connected to the cathode, and the intermediate tap is connected to the grid for the triode injector, such that the high voltage pulses provide an electric field over a surface of the cathode and extracted electrons from the cathode.

According to aspects of the invention, the invention includes a cathode that can be a field emission cathode. Further, the inductive means can have an induced voltage across the injection coil that is proportional to a rate of a flux change enclosed with the injection coil. Further still, the flux change due to an orbit control coil is greater than a rate of a main drive coil flux change. Further, the inductive means can include a core flux consisting of at least two components, a first component being a main drive coil and a second component being from a orbit control coil. It is possible, the inductive means provides for an induced voltage that occurs when an orbit control coil is trigger, e.g., during a proper injection window.

According to embodiments of the invention, the invention includes a betatron magnet comprising of at least one electron injector positioned approximate an inside of a radius of an betatron orbit, such that electrons are injected into the betatron orbit with the at least one electron injector positioned within an electron acceleration passageway, whereby the electron acceleration passageway is located within a vacuum chamber; and wherein the at least one electron injector is driven with an inductive means, such that the inductive means includes an injection coil wound around an inside portion of a vacuum chamber wall of the vacuum chamber, a positive end of the injection coil is connected to an anode, and a negative end of the injection coil is connected to a carbon nano tube (CNT) cathode and an intermediate tap is connected to a grid for a triode injector.

According to aspects of the invention, the invention includes the inductive means having a resistive coating is located on at least one portion of an interior surface of the vacuum chamber, and a ground connection is structured and arranged through an outside wall of the vacuum chamber to the resistive coating. Further, the inductive means ca drive the at least one electron injector, whereby high voltage pulses for driving the injector are obtained from the injection coil wound around the inside portion of the vacuum chamber wall, such that the positive end of the injection coil is connected to the anode and the resistive coating, and the negative end of the injection coil is connected to the CNT cathode, and the intermediate tap is connected to the grid for the triode injector, such that the high voltage pulses provide an electric field over a surface of the CNT cathode and extracted electrons from the CNT cathode.

According to embodiments of the invention, the invention includes a method of driving at least one electron injector for an internal injection scheme of a betatron magnet. The method comprising of the steps of injecting electrons into an betatron orbit with the at least one electron injector positioned within an electron acceleration passageway, wherein the at least one electron injector positioned approximate an inside of a radius of an betatron orbit; and driving the at least one electron injector with an inductive means.

According to aspects of the invention, the invention includes the method of the inductive means further comprises of the step of having an injection coil wound around an inside portion of a vacuum chamber wall of the vacuum chamber, a positive end of the injection coil is connected to an anode, and a negative end of the injection coil is connected to a cathode and an intermediate tap is connected to a grid for a triode injector. Further, the method includes the inductive means having one of a diode or an intermediate tap connected to a grid for a triode injector. Further still, the method includes the inductive means having a resistive coating is located on at least one portion of an interior surface of the vacuum chamber, and a ground connection is structured and arranged through an outside wall of the vacuum chamber to the resistive coating. It is possible the method includes the inductive means that drives the at least one electron injector, whereby high voltage pulses for driving the injector are obtained from the injection coil wound around the inside portion of the vacuum chamber wall, such that the positive end of the injection coil is connected to the anode and the resistive coating, and the negative end of the injection coil is connected to the cathode, and the intermediate tap is connected to the grid for the triode injector, such that the high voltage pulses provide an electric field over a surface of the cathode and extracted electrons from the cathode.

According to embodiments of the invention, the invention includes a method of driving at least one electron injector for an internal injection scheme of a betatron magnet. The method comprising the steps of injecting electrons into an betatron orbit with the at least one electron injector positioned within an electron acceleration passageway, wherein the at least one electron injector positioned approximate an inside of a radius of an betatron orbit; and driving the at least one electron injector with an inductive means, such that the inductive means includes an injection coil wound around an inside portion of a vacuum chamber wall of the vacuum chamber, a positive end of the injection coil is connected to an anode, and a negative end of the injection coil is connected to a carbon nano tube (CNT) cathode and an intermediate tap is connected to a grid for a triode injector.

According to aspects of the invention, the invention includes the method of wherein the inductive means further comprises wherein the inductive means includes a resistive coating is located on at least one portion of an interior surface of the vacuum chamber, and a ground connection is structured and arranged through an outside wall of the vacuum chamber to the resistive coating. Further, the method includes the steps of the inductive means drives the at least one electron injector, whereby high voltage pulses for driving the injector are obtained from the injection coil wound around the inside portion of the vacuum chamber wall, such that the positive end of the injection coil is connected to the anode and the resistive coating, and the negative end of the injection coil is connected to the CNT cathode, and the intermediate tap is connected to the grid for the triode injector, such that the high voltage pulses provide an electric field over a surface of the CNT cathode and extracted electrons from the CNT cathode.

Further features and advantages of the invention will become more readily apparent from the following detailed description when taken in conjunction with the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

According to embodiments of the invention, the invention includes a betatron magnet, the betatron magnet comprising at least one electron injector positioned approximate an inside of a radius of an betatron orbit, such that electrons are injected into the betatron orbit with the at least one electron injector positioned within an electron acceleration passageway, whereby the electron acceleration passageway is located within a vacuum chamber; and wherein the at least one electron injector is driven with an inductive means.

Brief Overview of the Invention

According to embodiments of the invention, the invention pertains to methods and devices of injecting electrons into the vacuum donut of a very small diameter betatron (approximately 3.5" or less). It is noted that the diameter of the betatron could be conceived to be larger than 3.5 inches disclosed. In particular, the methods and devices of the invention are related to driving an injector in internal injection scheme. Further, the methods and devices of the invention relate to at least one technique that includes driving the injector through an inductive means. Further still, the methods and devices of the invention may include a technique suitable for a field emitter type cathode or the like. For example, the high voltage needed to power an injector maybe coupled to an inside of a vacuum chamber through an interior coil wound around an inside wall of the vacuum chamber. Thus, in view of such a configuration or the like, there would be no longer a need for a high voltage feedthrough through the vacuum chamber wall. In particular, by non-limiting example, only a ground connection through the outside wall to the resistive coating on the interior surface would be needed.

Review of U.S. patent application Ser. No. 11/957,178

In order to better understand the present invention, it would be beneficial to review several aspects of the device as disclosed in U.S. patent application Ser. No. 11/957,178 to Chen et al. (hereafter "Chen device '178"), and is incorporated by reference in its entirety.

Figure 1:
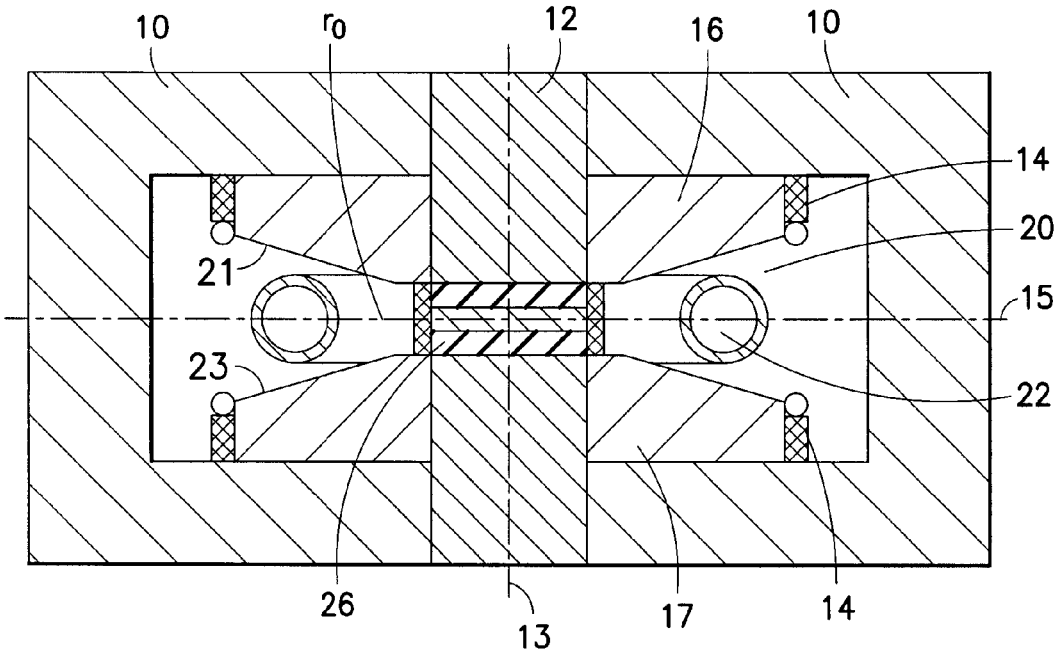
FIG. 1 PRIOR ART
FIG. 1 illustrates in cross sectional representation the magnet configuration and drive coil of a small diameter betatron design according to the device of U.S. patent application Ser. No. 11/957,178.

The Chen device '178 follows the convention approach of injecting the electrons near the outer radius of the vacuum donut. For example, FIG. 1 of the Chen device '178 illustrates a cross sectional representation of a betatron magnet, return yokes 10, first guide magnet 16 and second guide magnet 17 encircling a magnetic core 12. As noted above the Chen device '178 follows the convention approach of injecting the electrons near the outer radius of the vacuum donut. Further, both guide magnets 16, 17 and the core 12 has substantial radial symmetry about longitudinal axis 13, and mirror symmetry about a mid plane 15. The guide magnets 16, 17 are formed from a soft magnetic material, such as MND5700 ferrite manufactured by Ceramic Magnetics, Inc. of Fairfield, N.J., having a high permeability, such as about 2000, to readily conduct a magnetic flux. Due to the one or more gaps 26 in the magnetic core 12, the magnetic permeability of the betatron magnet has little effect on the magnetic properties that accelerate and direct the electrons, as long as the permeability is sufficiently high, such as about 2000. The gaps 26 may be air gaps or spacers formed from a non-magnetic material and non-conductive. The return yokes 10 may be formed from a magnetic material such as ferrite or, similar to the core described below as a hybrid having both an amorphous metal and a ferrite component. The Chen device '178 illustrates the magnetic core 12 that may have a composite a high saturation flux density interior and a fast but lower saturation flux density periphery, or vice versa. The main drive coil 14 is shown wound around both guide magnets 16, 17 of the betatron magnet. Typically, but not necessarily, the main drive coil 14 will have ten or more windings to reduce power consumption and have a suitable first magnetic flux rise time in relationship to the injector pulse rise time. Activation of the main drive coil 14 creates magnetic flux that confines and accelerates electrons contained within passageway 20. Passageway 20 is a region in space between the pole faces 21, 23 of the guide magnets. Stable instantaneous equilibrium electron orbits and focusing conditions of electrons exist within the confines of the passageway 20. Further, FIG. 1 shows contained within the passageway 20 a toroid shaped tube 22 formed from a low thermal expansion glass or ceramic whose interior surfaces are coated with a suitable resistive coating, such as 100-1000 ohms per square. When grounded, the coating prevents excessive surface charge buildup, which has a detrimental effect on the circulating electron beam. During betatron operation, the interior volume of the tube 22 is under a vacuum of about $1\times10^{-8}$ torr to about $1\times10^{-9}$ torr to minimize electron loss from collisions with residual gas molecules. The interior volume of the tube 22 overlaps the passageway 20 in such a way that stable instantaneous orbits do not intercept the tube wall.

Figure 2:
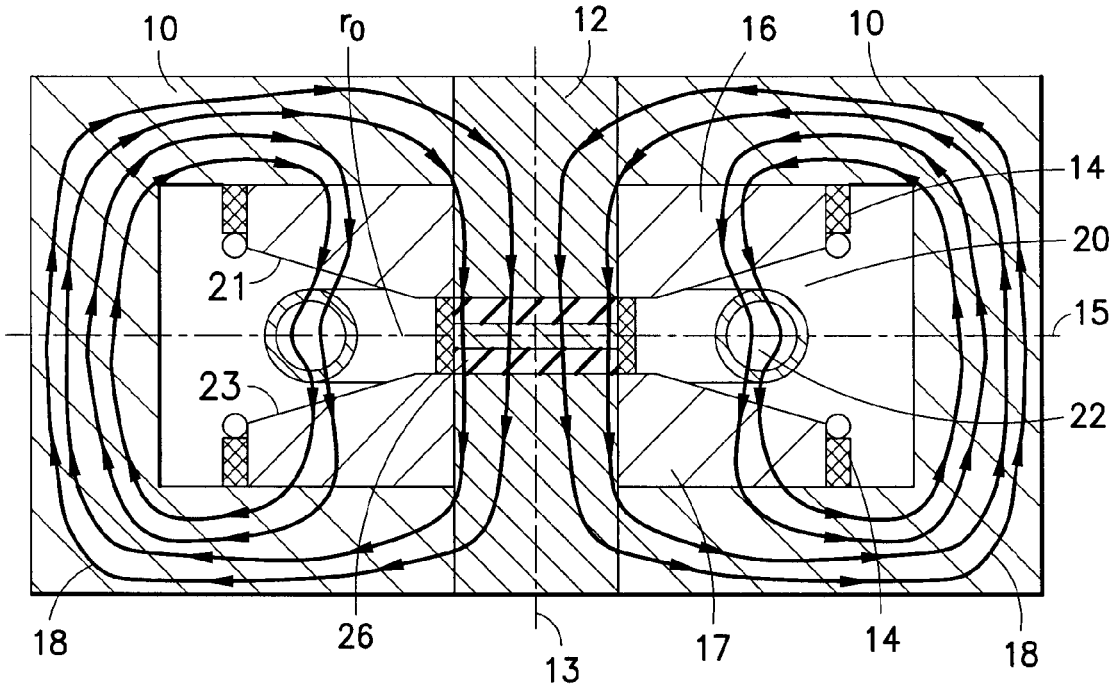
FIG.2 PRIOR ART
FIG. 2 illustrates the magnet configuration of FIG. 1 showing magnetic flux lines generated by the drive coil according to the device of U.S. patent application Ser. No. 11/957,178.

Further, FIG. 2 of the Chen device '178 shows the betatron magnet with flux lines 18 illustrating the magnetic field created by energizing the main drive coil 14. Further, the Chen device '178 shows that at the beginning of each cycle, a high voltage pulse (typically a few kV) is applied to the injector and causes electrons to be injected into the electron acceleration passageway.

To illustrate the sequence of operation in the Chen device '178 which follows the convention approach of injecting the electrons near the outer radius of the vacuum donut, consider an example in which the injection takes place near the outside edge of the passageway and $r_i$ lies just inside the injector structure. At the beginning of the injection window, a second magnetic flux is formed for a first time duration that passes mainly through a perimeter of the core at an opposing second polarity and returns through the electron passageway at the first polarity. The reducing flux within the core induces a deceleration electric field in the passageway, and at the same time the returning second magnetic flux through the passageway causes an increase of the magnetic field in the vicinity of electron trajectories.

Figure 3:
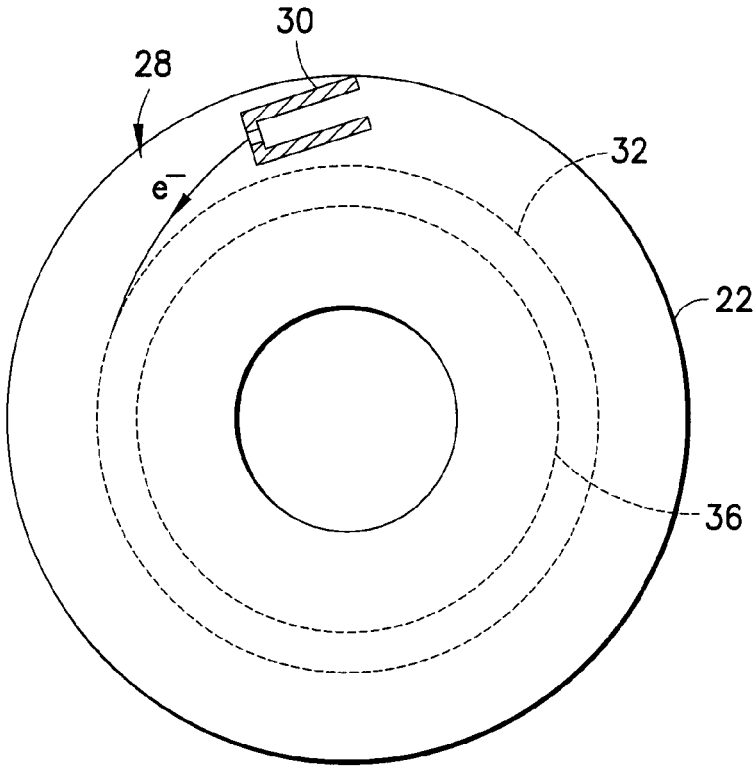
FIG.3 PRIOR ART
FIG. 3 illustrates a path for electrons injected into the betatron of FIG. 1 according to the device of U.S. patent application Ser. No. 11/957,178.
Figure 4:
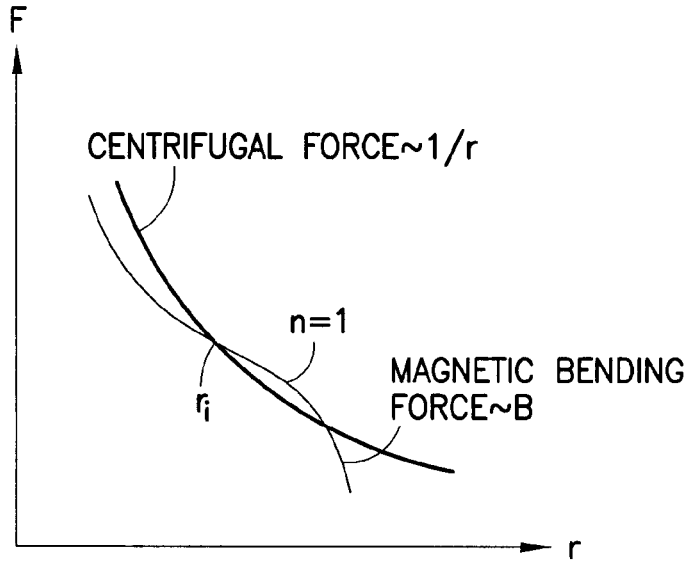
FIG. 4 illustrates the relationship between the centrifugal and radial magnetic bending forces, so as to give rise to the radial focusing according to the device of U.S. patent application Ser. No. 12/334,495.
Figure 5:
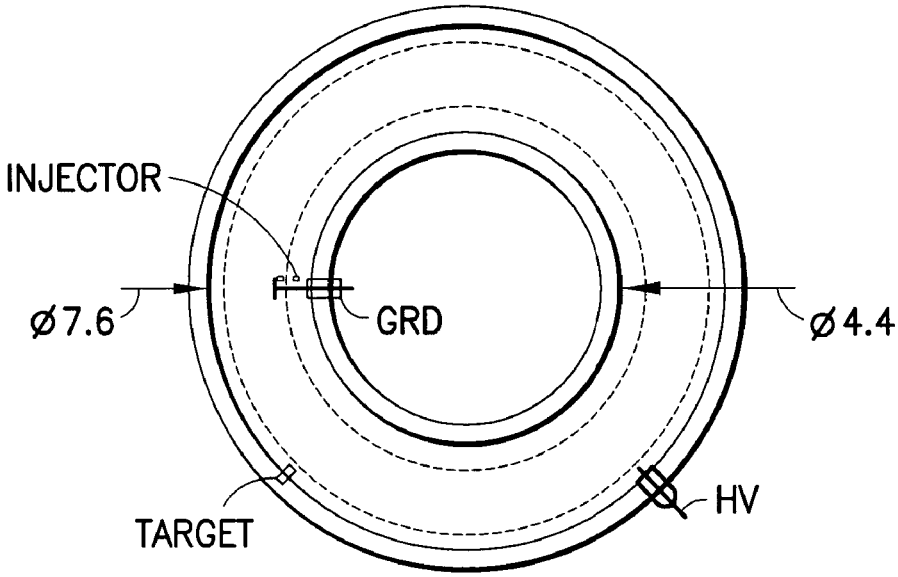
FIG. 5 illustrates the top view of a betatron vacuum donut, the two dashed circles indicate the location of the radial acceptance aperture, the target and the high voltage feed through can be the same structure according to the device of U.S. patent application Ser. No. 12/334,495.

The Chen device '178 as disclosed in FIG. 3 illustrates the interior volume of the tube 22 in latitudinal cross section. Electrons 28 are injected into the volume from an electron emitter 30, such as a thermal emission dispenser cathode. For an electron 28 injected at a specific energy that injects electrons near the outer radius of the vacuum donut, there is a corresponding orbit at the instantaneous equilibrium radius, $r_i$ 32 such that the magnetic bending force is equal and opposite to the centrifugal force. An electron injected into the betatron magnet at a location either inside or outside $r_i$ 32 will exhibit a track having oscillatory motion about $r_i$ and this oscillation is referred to as the betatron oscillation. The betatron oscillation frequency is slower than the orbital frequency such that the electron completes one or more revolutions around the volume per betatron oscillation. As the magnetic field increases, the betatron oscillation amplitude reduces and $r_i$ 32 moves closer to the betatron orbit 36 $r_o$ (betatron damping) the terminus of the radius (22 in FIG. 1). To avoid hitting the injector 30 in a small betatron one needs to change $r_i$ at a faster rate than the intrinsic betatron damping rate.

However, there is at least one drawback to the Chen device '178 which is that the geometry of the electron trapping scheme may have efficiency issues in terms of its radiation output. It is suspected that the efficiency issues may be due in part to using a conventional approach of injecting electrons into the vacuum donut of the betatron (3.5" or less) near the outer radius.

Therefore there remains a need for a better geometry for an electron trapping scheme which can significantly improve the efficiency over that of the disclosed electron trapping scheme of the Chen device '178.

Review of the U.S. patent application Ser. No. 12/334,495

Further, to better understand the present invention, it would be further beneficial to review several aspects of the device as disclosed in U.S. patent application Ser. No. 12/334,495, titled "Internal Injection Betatron" by Felix Chen filed Dec. 13, 2008 (hereafter "Chen device '495"), and is incorporated by reference in its entirety.

The Chen device '495 includes injecting electrons into the vacuum donut of a very small diameter betatron (3.5" or less), by injecting electrons near the inner radius of the vacuum donut, as oppose to the conventional approach of injecting near the outer radius, e.g., as in the Chen device '178. At least one advantage of the Chen device '495 geometry is that it significantly improves the efficiency of the previously disclosed electron trapping scheme of the Chen device '178, by providing results that have a much higher radiation output. For example, the radiation output is increased over the device disclosed in the Chen device '178 by placing the electron injector inside the radius of the main electron orbit and using a separate target placed near the outer edge of the betatron magnet. In contrast to the Chen device '178, the device disclosed in the Chen device '495 has an electron orbit that expands rather than contracts following injection. Accordingly, the electric impulse applied to the orbit control coil is in opposite polarity to that of external injection.

In particular, the source intensity from the betatron depends on two factors: the number of electrons hitting the target and the energy of those electrons. The latter is limited by material properties and available power whereas the former is mainly an issue of the amount of charge trapped, which is in turn affected by strength of the focusing forces, the space charge forces, and the efficiency of the charge trapping mechanism.

Figure 9:
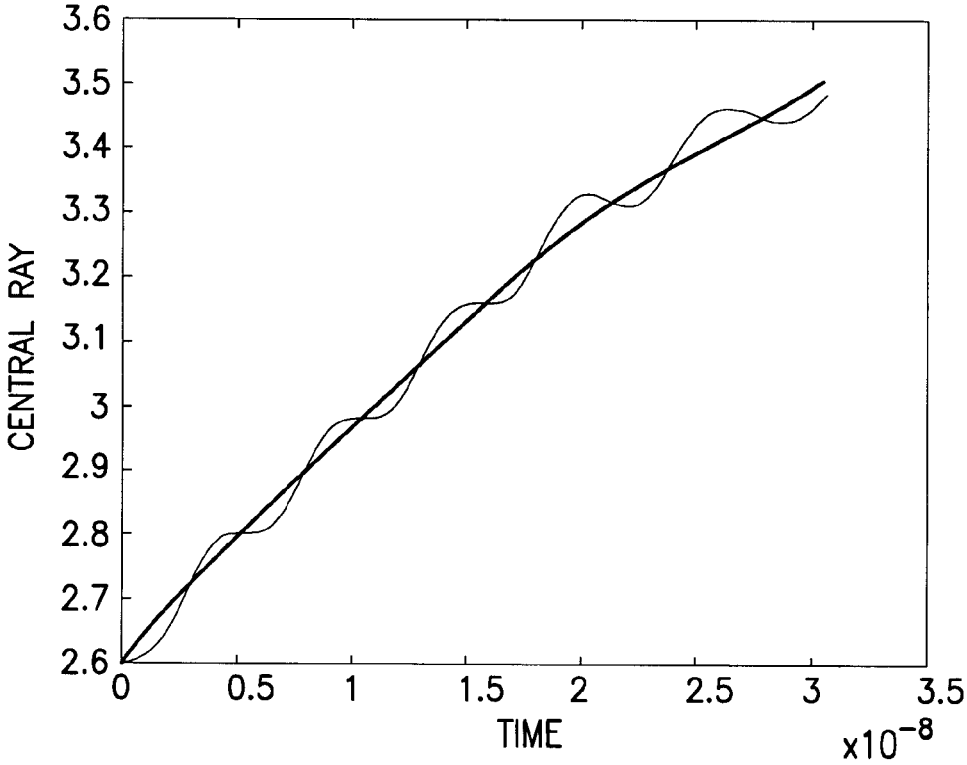
FIG. 9 illustrates a central ray orbit ($r_c$) and instantaneous orbit expansions at 7 keV injection, wherein the orbital control coil capacitor voltage (322V), orbit control coil voltage switched off at 17 ns after time 0 with 10 ns decay constant, such that all the parameters of FIG. 7 are the same, according to embodiments of the invention.

Further, the Chen device '495 in FIG. 9 illustrates a top view of a betatron vacuum donut. Also shown are the radial aperture and an injector mounted on the inner radius of the donut. Generally speaking, the size of the injector depends very much on the type of cathode used. For thermionic cathode, i.e. dispenser cathode, the overall injector may be somewhat larger than a field emission cathode because the extra space needed for heating wires and thermal insulation. Another disadvantage of using a dispenser cathode is that an extra electric feedthrough is needed to provide the heating power (albeit at essentially ground potential). The main advantage of a dispenser cathode is that its emission density is still considerably higher than other candidates. An alternative is a cold cathode such as carbon nano tubes field emission cathodes. An injector with a CNT emitter can be made extremely small using semiconductor fabrication technologies. It also doesn't need heating power. However, at the present time its emission density is still a factor of 2-3 below that of the dispenser cathode. Multiple injectors scheme can be of great help here.

The injector is normally powered by a negative high voltage pulse to the cathode. The high voltage pulse must go through the vacuum wall. This is where the main challenge lies due to poor accessibility of an internal injector. The desirable voltage pulse is about 3-7 kV and ≅1 μs in duration. An electric feedthrough with a 7 kV standoff capability is several mm in length. In addition, the high voltage cable also requires insulation. There simply isn't enough space to accommodate the feedthrough and the cable through the inside wall as most of that space is occupied by magnet. A much more elegant solution is to drive the injector with a positive high voltage pulse to the anode and feed the high voltage through the outside wall and connect it to the interior surface. It is noted that this can be done because the exposed interior surface is coated with a resistive coating (on the order of 100Ω per square) to prevent surface charge buildup. Thus, the inside volume of the vacuum donut is essentially a Faraday's cage, i.e. the entire volume is at the same potential. The positive voltage applied to the anode extracts electrons from the cathode in the same way as a negative voltage applied to the cathode does. Once electrons leave the injector they enter a free space just as in the external injection. The only electric lead that needs to go through the inside wall is the connection to the cathode, which is at ground potential.

For a triode injector, one also needs to provide a grid voltage. This can be accomplished with a voltage divider connecting anode, grid and cathode. The high voltage insulators separating electrodes may also serve as the voltage divider if appropriate bulk resistive ceramics are used. Alternatively the divider may be painted or printed on the insulator surface since its power rating is very low.

For field emission arrays such as CNTs, the emission density at a fixed extraction electric field often drops as the cathode ages. To compensate one must increase the extraction field in order to maintain the same current. A fixed internal voltage divider doesn't have the flexibility of changing the grid voltage relative to those of the anode and cathode. The extraction field is increased by increasing the amplitude of the anode voltage pulse whether the injector is a diode or triode. This in turn leads to higher injection energy and other appropriate parameters such as injection timing, orbit control voltage and timing should be adjusted accordingly. Once the responses of relevant parameters have been mapped out, the adjustment may be done automatically using the detected radiation intensity of a source monitor as a feedback control.

However, this approach, although considerably simpler than delivering a negative high voltage pulse to the injector cathode through the interior wall, still requires feeding a ground connection to the cathode through the interior wall. Since the interior space is completely filled by the contraction coil and the betatron core magnet, installing even a grounded feedthrough through the interior wall of the vacuum chamber presents a formidable challenge.

Therefore there remains a need for a better way to drive the injector in an internal injection betatron.

Description of Embodiments of the Invention

Figure 6:
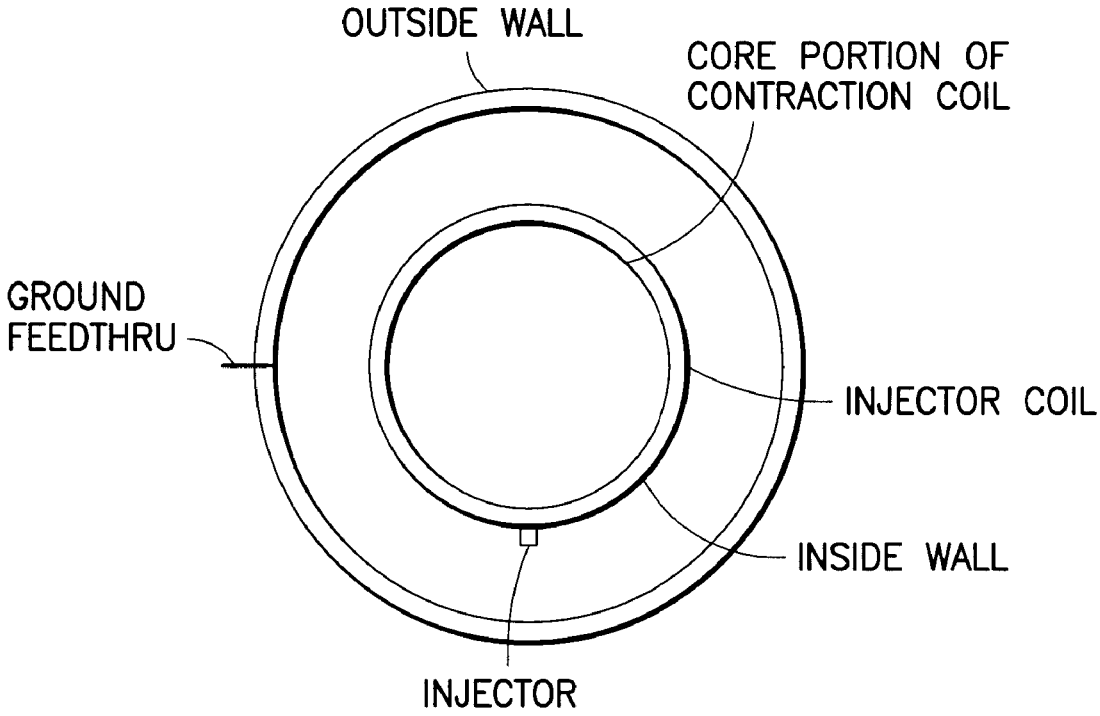
FIG. 6 illustrates a top view of a vacuum chamber and an injector coil location, according to embodiments of the invention.
Figure 7:
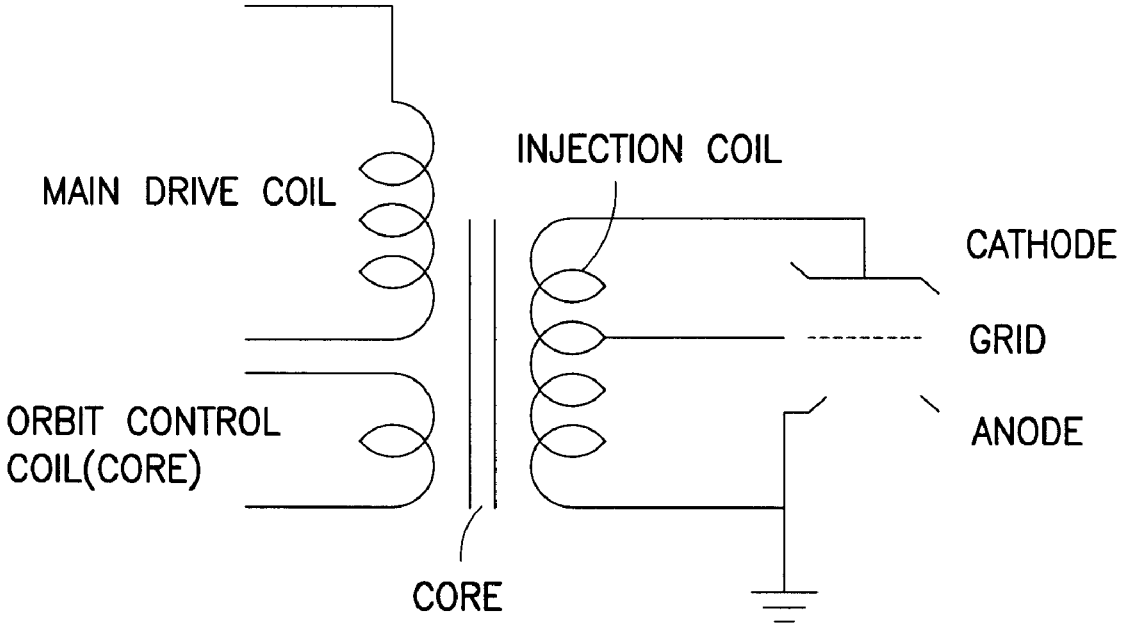
FIG. 7 illustrates an Electric circuit equivalent of an injector driver, according to embodiments of the invention.

Referring to FIG. 6 and FIG. 7, FIG. 6 discloses a top view of a vacuum chamber and an injector coil location. In particular, the main component of the present invention is an injector coil wound around the inside vacuum chamber wall. The positive end of the coil is connected to the anode and the resistive coating on the interior vacuum chamber surfaces, and the negative end is connected to the cathode. FIG. 7 shows the equivalent circuit of the injector driver. This coil acts as the secondary of a pulse transformer and it couples the high voltage pulses to the injector through the inside vacuum chamber wall without the need of an electric feedthrough. Another benefit of this driving scheme is that it can be used with either a diode or a triode injector. In the case of a triode injector all one needs is an extra tap from the injector coil for grid voltage connection. There is no need for a voltage divider. As one changes the injection energy to maintain constant emission from a CNT cathode, the differential voltage ratio between cathode-grid and grid-anode remains the same; consequently, the beam optics shouldn't change either Still referring to FIGS. 6 and 7, several considerations went into the design of the injection coil. The induced voltage across the injection coil is proportional to the rate of flux change enclosed within the coil, or $\dot{\phi}_c$. The core flux $\phi_c$ consists of two components: one component $\phi_{c1}$ is due to the main drive coil and the other one $\phi_{c2}$ is from the orbit control coil. By virtue of its design, the rate of flux change due to the orbit control coil is much greater than the rate of main drive coil flux change. Thus, most of the induced voltage occurs when the orbit control coil is triggered (i.e. during the proper injection window). Nevertheless, during each cycle there is a small induced voltage due to the main drive coil. For a CNT cathode it is desirable to keep the duration of electron emission as short as possible. The typical emission threshold for a fresh CNT emitter is about 2 MV/m. The I-V emission curve shifts to the right as the cathode ages, and the emission threshold increases. It is important to keep the induced voltage due to the main drive coil to below that threshold Still referring to FIGS. 6 and 7, another important consideration is the orbit expansion rate. To compensate for CNT emission reduction due to aging, one has to increase the injection energy, which leads to higher extraction voltage. This is done by increasing the voltage applied to the orbit control coil. However, doing so also affects the orbit expansion rate during injection. Ideally, one wishes to maintain the same orbit expansion per revolution $\Delta r_i$, independent of the injection energy. Unfortunately, this isn't possible. Nevertheless, one can design the system so that $\Delta r_i$ doesn't change too much. The orbit expansion per revolution is given by[2]

$$\Delta r_i = \frac{1}{vB_i(1-n)}\left\{\frac{\partial \phi_i}{\partial t} - 2\pi r_i^2 \frac{\partial B_i}{\partial t}\right\} \quad \text{Eq. (1)}$$

where $B_i$ and $\phi_i$ are magnetic field at, and flux within, the instantaneous equilibrium orbit $r_i$, v is electron injection velocity and n is the local field index. Since $B_i$ is approximately proportional to the injection velocity, the denominator in the above expression is proportional to the injection energy, which in turn is proportional to $\dot{\phi}_c=\dot{\phi}_{c1}+\dot{\phi}_{c2}$. One can also express the two terms in the parentheses in terms of $\dot{\phi}_{c1}$ and $\dot{\phi}_{c2}$:

$$\frac{\partial \phi_{i1}}{\partial t} = \dot{\phi}_{c1} + \alpha_i \dot{\phi}_{c1}$$

$$\frac{\partial \phi_{i2}}{\partial t} = \dot{\phi}_{c2} - \alpha_i \dot{\phi}_{c2}$$

$$2\pi r_i^2 \frac{\partial B_{i1}}{\partial t} = \beta_i \dot{\phi}_{c1}$$

$$2\pi r_i^2 \frac{\partial B_{i2}}{\partial t} = -\beta_i \dot{\phi}_{c2}$$

where $\alpha_1$ is a geometrical factor to account for the fact that $r_i$ is greater than the radius of the core. The negative sign for $\dot{\phi}_{c2}$ accounts for the fact that the core flux and orbital region flux due to the orbit control coil have opposite polarities. Similarly, the geometrical factor $\beta_i$ connects $\partial B_{i1,2}/\partial t$ to $\dot{\phi}_{c1,2}$. The expression within the parentheses in eqn. (1) becomes:

$$(1+\alpha_i-\beta_i)\dot{\phi}_{c1}+(1-\alpha_i+\beta_i)\dot{\phi}_{c2}$$

The first term represents the natural betatron damping, which is much smaller than the forced orbit expansion (the $2^{nd}$ term). If $r_i$ is at the betatron orbit, then $1+\alpha-\beta=0$. If $r_i$ is smaller than the betatron orbit, such as the case of internal injection, then $1+\alpha_i-\beta_i$ is a small but positive number. Thus, $\beta_i \approx 1+\alpha_i$, and $1-\alpha_i+\beta_i \approx 2$. It follows that $$\Delta r_i \propto \frac{\dot{\phi}_{c2}}{\dot{\phi}_{c1}+\dot{\phi}_{c2}} \qquad \text{Eq. (2)}$$

It is noted that it can be conclude that if $\dot{\phi}_{c1}$ is negligible then $\Delta r_i$ is insensitive to the injection energy. Otherwise, it increases with the injection energy. A larger $\Delta r_i$ translates into a smaller injection window. It is therefore desirable to reduce $\dot{\phi}_{c1}$ as much as reasonable by increasing the number of turns of the main drive coil and/or the capacitance of the main drive capacitor. On the other hand, the smaller $\dot{\phi}_{c1}$ is, the larger $\dot{\phi}_{c2}$ must be in order to generate sufficient voltage to power the injector. In the remainder of this document I'll give an example to illustrate how to design such a system. For example, assume the following main betatron parameters:

1. The injector is a triode with 200 μm cathode to grid spacing, and the minimum desirable injection energy is 4 kV;
2. The maximum beam energy is 1.5 MeV and the corresponding magnet excitation energy is 1.7 J;
3. The main capacitor is 5 μf. The initial voltage corresponding to 1.7 J is 825V;
4. The main drive coil has 30 turns;
5. The proper orbit control coil voltage at 4 keV injection energy is 175V (FIG. 7).

According to the given cathode to grid spacing the maximum allowable grid voltage due to the main drive coil at 4 kV injection is 400V in order to stay below the emission threshold. This voltage determines the location of the grid tap on the injection coil after all other parameters are determined.

Next, it is noted to determine the number of turns $N_{inj}$ needed for the injection coil. Since the core carries ½ of the total main drive coil flux, the induced voltage on the injection coil is:

$$\frac{1}{2} \times 825 \times \frac{N_{inj}}{30} = 13.75 \times N_{inj}$$

When the orbit control coil (which has two turns wound around the core) is triggered at 4 keV injection, the voltage induced is:

$$\frac{N_{inj}}{2} \times 175 = 87.5 \times N_{inj}$$

Thus, the total voltage across the injection coil is $$(87.5+13.75)\times N_{inj}=4000,$$

and $$N_{inj}=40$$

A 40 turn coil wound around the inside wall of the vacuum chamber may seem a lot, however, it carries only a few mA and can use very small gauge wire. To avoid perturbing the orbit the coil should be shield. The shield may be as simple as a thin copper foil with an insulating gap at the overlapping ends (FIG. 6). Also, one notice that $$\dot{\phi}_{c1} = \frac{13.75}{87.5}\dot{\phi}_{c2} \approx 0.157\dot{\phi}_{c2}$$

which is definitely not negligible. One can change the main drive coil parameters to further reduce the relative value of $\dot{\phi}_{c1}$. The parameters chosen for this example aren't optimized but they serve the purpose of illustrating design procedures.

Figure 8:
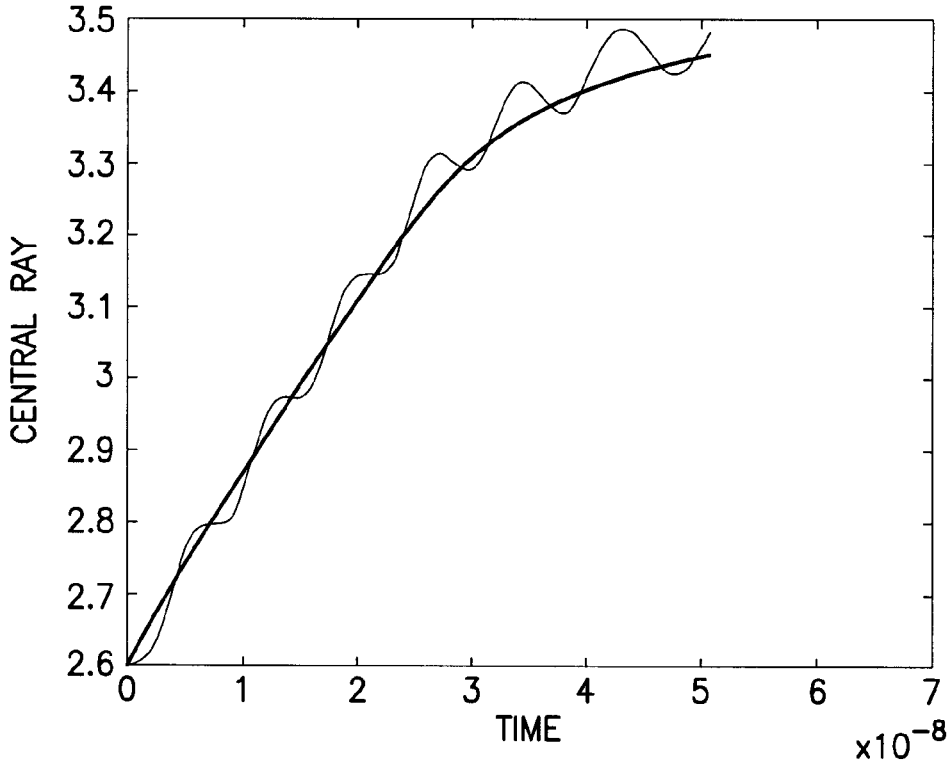
FIG. 8 illustrates a central ray orbit ($r_c$) and instantaneous orbit expansions at 4 keV injection, wherein each color represents one complete revolution, according to embodiments of the invention.

Referring to FIG. 8, it is noted that although the emission threshold is ⌴2 MeV/m, to extract 2 mA from a 1 mm CNT FEA one would probably need ⌴4 MeV/m, or about 800V between the grid and the cathode at 200 μm spacing. At 4 kV total voltage, the grid tap should be at 20% point. The corresponding "background" grid to cathode voltage due to the main drive coil is:

$$800\times 13.75/(87.5+13.75)=109\text{V}$$

which is well below the emission threshold. FIG. 8 illustrates the central ray orbit ($r_c$) and instantaneous orbit expansions at 4 keV injection, wherein each color represents one complete revolution. Further, the relevant parameters are: orbit control coil capacitor voltage=175V, orbit control coil voltage switched off 24 ns after time 0 with 10 ns decay constant, $r_i=r_c=2.6$ cm, betatron orbit $r_b=3$ cm, maximum beam energy 1.5 MeV, main coil modulation frequency=15.52 kHz, total charge in aperture 25 pC, injection angle=0.1°, injection energy slew rate=0. FIG. 8 also illustrates the results of an orbit dynamics simulation code. The orbit expansion voltage is switched off at 24 ns, or about 5 revolutions.

Over the life time of the CNT cathode one may have to increase the extraction field to, say, 7 MeV/m. The corresponding injection energy is 7 keV. The contribution from the main drive coil remains more or less the same at 13.75×40=550V. The remainder must come from the orbit control coil. The required orbit control coil voltage is therefore:

$$(7000-550)\times\frac{2}{40} = 322 \text{ V}.$$

According to Eq. (2), the orbit expansion per turn increases by a factor of:

$$\frac{(7000-550)/7000}{(4000-550)/4000} = \frac{0.92}{0.86} \approx 1.07,$$

which leads to a slight reduction of the injection window, from about 5 revolutions to 4.7 revolutions. At 7 keV, the electron orbit time is 30% shorter than at 4 keV. Thus, the proper injection window is reduced from 24 ns to 24×(4.7/5) ÷1.3≈17 ns. The simulation results are given in FIG. 9. The orbit expands from 2.6 cm to 3.5 cm in about 30 ns vs. 43 ns at 4 keV injection as expected.

One or more embodiments of the present invention have been described. Nevertheless, it will be understood that various modifications may be made without departing from the spirit and scope of the invention. It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A betatron magnet, the betatron magnet comprising:

at least one electron injector positioned inside of a radius of a betatron orbit, such that electrons are injected into the betatron orbit with the at least one electron injector positioned within an electron acceleration passageway, wherein the electron acceleration passageway is located within a vacuum chamber; and wherein the at least one electron injector is driven with an inductive means.

2. The betatron magnet of claim 1, wherein the inductive means includes an injection coil wound around an inside portion of a vacuum chamber wall of the vacuum chamber, such that a positive end of the injection coil is connected to an anode, and a negative end of the injection coil is connected to a cathode.

3. The betatron magnet of claim 2, wherein the inductive means includes one of a diode, or an intermediate tap connected to a grid for a triode injector.

4. The betatron magnet of claim 3, wherein the inductive means includes a resistive coating located on at least one portion of an interior surface of the vacuum chamber, and a ground connection is structured and arranged through an outside wall of the vacuum chamber to the resistive coating.

5. The betatron magnet of claim 4, wherein the inductive means drives the at least one electron injector, wherein high voltage pulses for driving the injector are obtained from the injection coil wound around the inside portion of the vacuum chamber wall, such that the positive end of the injection coil is connected to the anode and the resistive coating, and the negative end of the injection coil is connected to the cathode, and the intermediate tap is connected to the grid for the triode injector, such that the high voltage pulses provide an electric field over a surface of the cathode and extracted electrons from the cathode.

6. The betatron magnet of claim 2, wherein the cathode is a field emission cathode.

7. The betatron magnet of claim 2, wherein the inductive means includes an induced voltage across the injection coil that is proportional to a rate of a flux change enclosed within the injection coil.

8. The betatron magnet of claim 6, wherein a flux change due to an orbit control coil is greater than a rate of a main drive coil flux change.

9. The betatron magnet of claim 2, wherein the inductive means includes a core flux consisting of at least two components, a first component being a main drive coil and a second component being from an orbit control coil.

10. The betatron magnet of claim 2, wherein the inductive means provides for an induced voltage that occurs when an orbit control coil is triggered during a proper injection window.

11. A betatron magnet, the betatron magnet comprising:

at least one electron injector positioned approximate an inside of a radius of an betatron orbit, such that electrons are injected into the betatron orbit with the at least one electron injector positioned within an electron acceleration passageway, wherein the electron acceleration passageway is located within a vacuum chamber; and wherein the at least one electron injector is driven with an inductive means, such that the inductive means includes an injection coil wound around an inside portion of a vacuum chamber wall of the vacuum chamber, a positive end of the injection coil is connected to an anode, and a negative end of the injection coil is connected to a carbon nano tube (CNT) cathode and an intermediate tap is connected to a grid for a triode injector.

12. The betatron magnet of claim 8, wherein the inductive means includes a resistive coating located on at least one portion of an interior surface of the vacuum chamber, and a ground connection is structured and arranged through an outside wall of the vacuum chamber to the resistive coating.

13. The betatron magnet of claim 12, wherein the inductive means drives the at least one electron injector, wherein high voltage pulses for driving the injector are obtained from the injection coil wound around the inside portion of the vacuum chamber wall, such that the positive end of the injection coil is connected to the anode and the resistive coating, and the negative end of the injection coil is connected to the CNT cathode, and the intermediate tap is connected to the grid for the triode injector, such that the high voltage pulses provide an electric field over a surface of the CNT cathode and extracted electrons from the CNT cathode.

14. A method of driving at least one electron injector for an internal injection scheme of a betatron magnet, the method comprising:

injecting electrons into a betatron orbit with the at least one electron injector positioned within an electron acceleration passageway, wherein the at least one electron injector is positioned inside of a radius of the betatron orbit; and driving the at least one electron injector with an inductive means.

15. The method of claim 14, wherein the inductive means further comprises an injection coil wound around an inside portion of a vacuum chamber wall of the vacuum chamber, a positive end of the injection coil is connected to an anode, and a negative end of the injection coil is connected to a cathode and an intermediate tap is connected to a grid for a triode injector.

16. The method of claim 15, wherein the inductive means includes one of a diode, or an intermediate tap connected to a grid for a triode injector.

17. The method of claim 16, wherein the inductive means includes a resistive coating that is located on at least one portion of an interior surface of the vacuum chamber, and a ground connection is structured and arranged through an outside wall of the vacuum chamber to the resistive coating.

18. The method of claim 17, wherein the inductive means drives the at least one electron injector, wherein high voltage pulses for driving the injector are obtained from the injection coil wound around the inside portion of the vacuum chamber wall, such that the positive end of the injection coil is connected to the anode and the resistive coating, and the negative end of the injection coil is connected to the cathode, and the intermediate tap is connected to the grid for the triode injector, such that the high voltage pulses provide an electric field over a surface of the cathode and extracted electrons from the cathode.

19. A method of driving at least one electron injector for an internal injection scheme of a betatron magnet, the method comprising:

injecting electrons into an betatron orbit with the at least one electron injector positioned within an electron acceleration passageway, wherein the at least one electron injector positioned approximate an inside of a radius of an betatron orbit; and driving the at least one electron injector with an inductive means, such that the inductive means includes an injection coil wound around an inside portion of a vacuum chamber wall of the vacuum chamber, a positive end of the injection coil is connected to an anode, and a negative end of the injection coil is connected to a carbon nano tube (CNT) cathode and an intermediate tap is connected to a grid for a triode injector.

20. The method of claim 19, wherein the inductive means includes a resistive coating is located on at least one portion of an interior surface of the vacuum chamber, and a ground connection is structured and arranged through an outside wall of the vacuum chamber to the resistive coating.

21. The method of claim 20, wherein the inductive means drives the at least one electron injector, wherein high voltage pulses for driving the injector are obtained from the injection coil wound around the inside portion of the vacuum chamber wall, such that the positive end of the injection coil is connected to the anode and the resistive coating, and the negative end of the injection coil is connected to the CNT cathode, and the intermediate tap is connected to the grid for the triode injector, such that the high voltage pulses provide an electric field over a surface of the CNT cathode and extracted electrons from the CNT cathode.

* * * * *